US012435921B2

(12) United States Patent
Parikshit et al.

(10) Patent No.: US 12,435,921 B2
(45) Date of Patent: Oct. 7, 2025

(54) REFRIGERATOR AND SHELVING SYSTEM FOR A REFRIGERATOR

(71) Applicant: WHIRLPOOL CORPORATION, Benton Harbor, MI (US)

(72) Inventors: Gowardhan Parikshit, Pune (IN); Ryan Post, Coloma, MI (US); Chad Rotter, Saugatuck, MI (US); Lalit Madhukar Suryawanshi, Pune (IN)

(73) Assignee: Whirlpool Corporation, Benton Harbor, MI (US)

( * ) Notice: Subject to any disclaimer, the term of this patent is extended or adjusted under 35 U.S.C. 154(b) by 126 days.

(21) Appl. No.: 18/503,875

(22) Filed: Nov. 7, 2023

(65) Prior Publication Data

US 2025/0146741 A1 May 8, 2025

(51) Int. Cl.
*F25D 25/02* (2006.01)

(52) U.S. Cl.
CPC ..... *F25D 25/02* (2013.01); *F25D 2325/021* (2013.01); *F25D 2325/022* (2013.01)

(58) Field of Classification Search
CPC ..... F25D 25/02; F25D 2325/021; F25D 2325/022
See application file for complete search history.

(56) References Cited

U.S. PATENT DOCUMENTS

| | | | | |
|---|---|---|---|---|
| 7,950,756 | B2 * | 5/2011 | Collins | F25D 25/02 312/248 |
| 8,397,923 | B2 * | 3/2013 | Tan | F16M 13/027 211/85.15 |
| 8,851,306 | B2 * | 10/2014 | Spurr | A47B 46/005 211/117 |
| 11,435,133 | B1 * | 9/2022 | Barik | F25D 25/02 |
| 2023/0175766 | A1 * | 6/2023 | Brown | F25D 25/02 312/9.47 |
| 2024/0219104 | A1 * | 7/2024 | Lim | E06B 7/20 |

FOREIGN PATENT DOCUMENTS

| | | | | |
|---|---|---|---|---|
| CN | 104976856 | A | 10/2015 | |
| CN | 112413969 | A * | 2/2021 | |
| CN | 114608244 | A * | 6/2022 | F25D 11/00 |
| JP | H-05317127 | A * | 12/1993 | |
| KR | 100650745 | B1 | 11/2006 | |
| KR | 1020080108673 | A * | 12/2008 | |
| KR | 101808441 | B1 * | 12/2017 | |
| WO | WO-2016180933 | A1 * | 11/2016 | A47B 96/066 |
| WO | WO-2022088044 | A1 * | 5/2022 | |

* cited by examiner

*Primary Examiner* — Andrew Roersma
(74) *Attorney, Agent, or Firm* — Brooks Kushman P.C.

(57) ABSTRACT

A refrigerator shelving system includes a primary shelf, a secondary shelf, hangers, and nests. The hangers movably secure the secondary shelf to the primary shelf. The hangers also position the secondary shelf below the primary shelf. The nests are configured to secure the secondary shelf to the primary shelf in a stowed position. The nests include housings and magnets that are vertically slidable within the housings. The magnets are configured to engage the hangers to maintain the secondary shelf in the stowed position. Vertical positions of the magnets are variable within the housing to compensate for variations in positions of the hangers.

20 Claims, 9 Drawing Sheets

REFRIGERATOR AND SHELVING SYSTEM FOR A REFRIGERATOR

TECHNICAL FIELD

The present disclosure relates to an appliance such as a refrigerator.

BACKGROUND

In order to keep food fresh, a low temperature must be maintained within a refrigerator to reduce the reproduction rate of harmful bacteria. Refrigerators circulate refrigerant and change the refrigerant from a liquid state to a gas state by an evaporation process in order cool the air within the refrigerator. During the evaporation process, heat is transferred to the refrigerant. After evaporating, a compressor increases the pressure, and in turn, the temperature of the refrigerant. The gas refrigerant is then condensed into a liquid and the excess heat is rejected to the ambient surroundings. The process then repeats.

SUMMARY

A refrigerator shelving system includes an upper shelf, a hanger, a lower shelf, and a nest. The hanger is secured to the upper shelf. The lower shelf is suspended below the upper shelf via the hanger. The lower shelf is configured to transition via the hanger between a deployed position where the lower shelf is spaced-apart from the upper shelf and a stowed position where the lower shelf is nested to the upper shelf. The nest is secured to a bottom of the upper shelf. The nest is configured to secure the lower shelf in the stowed position. The nest includes a magnet configured to engage the hanger to secure the lower shelf in the stowed position and a biasing element disposed between the magnet and the upper shelf. The biasing element is configured to absorb energy in response to engagement between the hanger and the magnet. The biasing element is also configured to adjust an alignment of the magnet in response to variations in a position of the hanger.

A refrigerator shelving system includes a first shelf, a second shelf, a first hanger, a second hanger, a first magnet, a second magnet, a first biasing element, and a second biasing element. The first and second hangers are rotatably secured to the first and second shelves such that the second shelf is configured rotate via the first and second hangers between an operational position where the second shelf is spaced-apart from the first shelf and a stowed position where the second shelf is nested to the first shelf. The first and second magnets are secured to the first shelf. The first and second magnets are configured to engage the first and second hangers, respectively, to secure the second shelf in the stowed position. The first and second biasing elements are disposed between the first shelf and the first and second magnets, respectively. The first and second biasing elements are configured to absorb energy in response to engagement between the first and second hangers and the first and second magnets. The first and second biasing elements are also configured to adjust an alignment of the first and second magnets in response to variations in positions of the first and second hangers.

A refrigerator shelving system includes a primary shelf, a secondary shelf, hangers, and nests. The hangers movably secure the secondary shelf to the primary shelf. The hangers also position the secondary shelf below the primary shelf. The nests are configured to secure the secondary shelf to the primary shelf in a stowed position. The nests include housings and magnets that are vertically slidable within the housings. The magnets are configured to engage the hangers to maintain the secondary shelf in the stowed position. Vertical positions of the magnets are variable within the housing to compensate for variations in positions of the hangers.

DETAILED DESCRIPTION

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Figure 1:
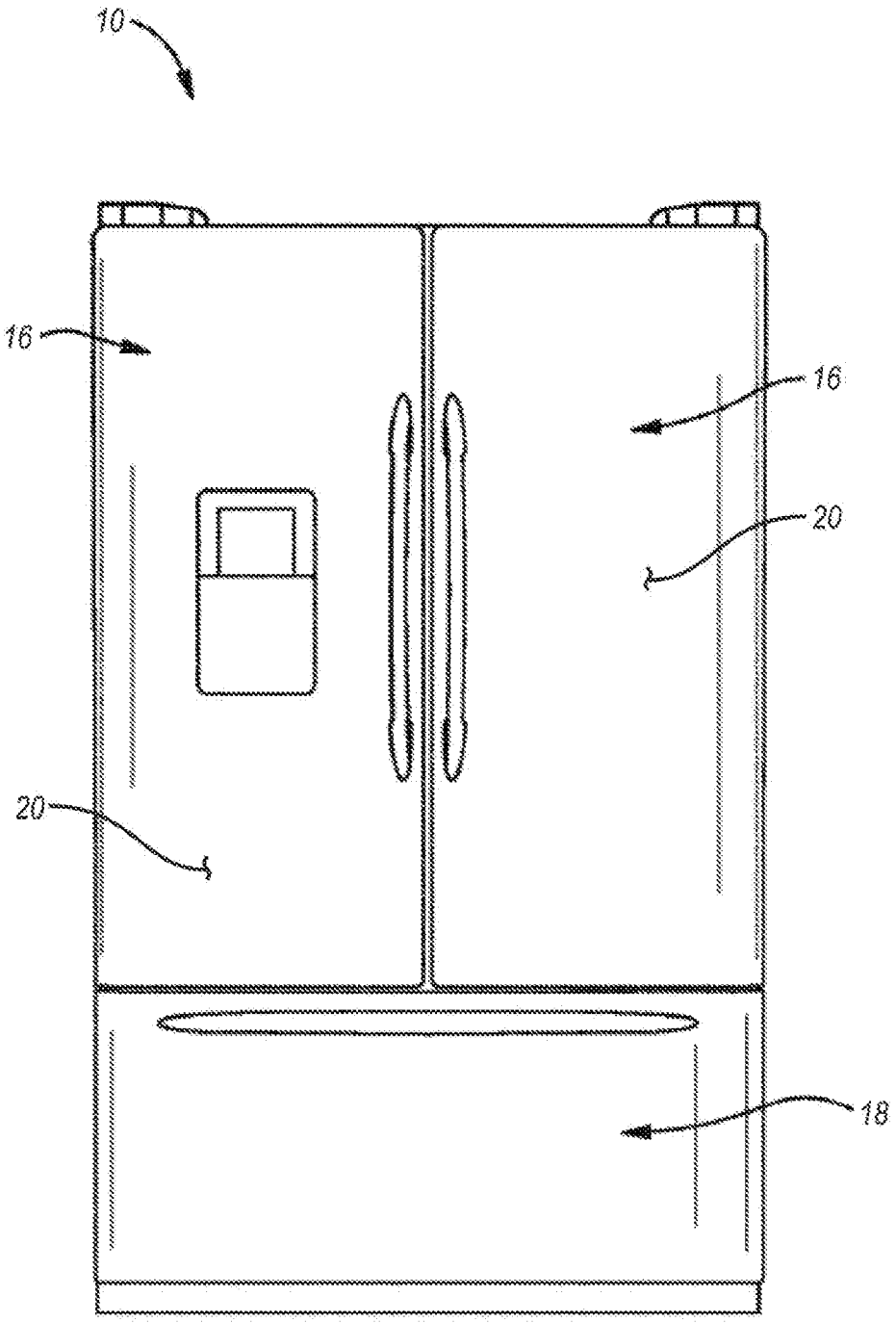
FIG. 1 is an elevated front view of a French-Door Bottom Mount type refrigerator appliance.
Figure 2:
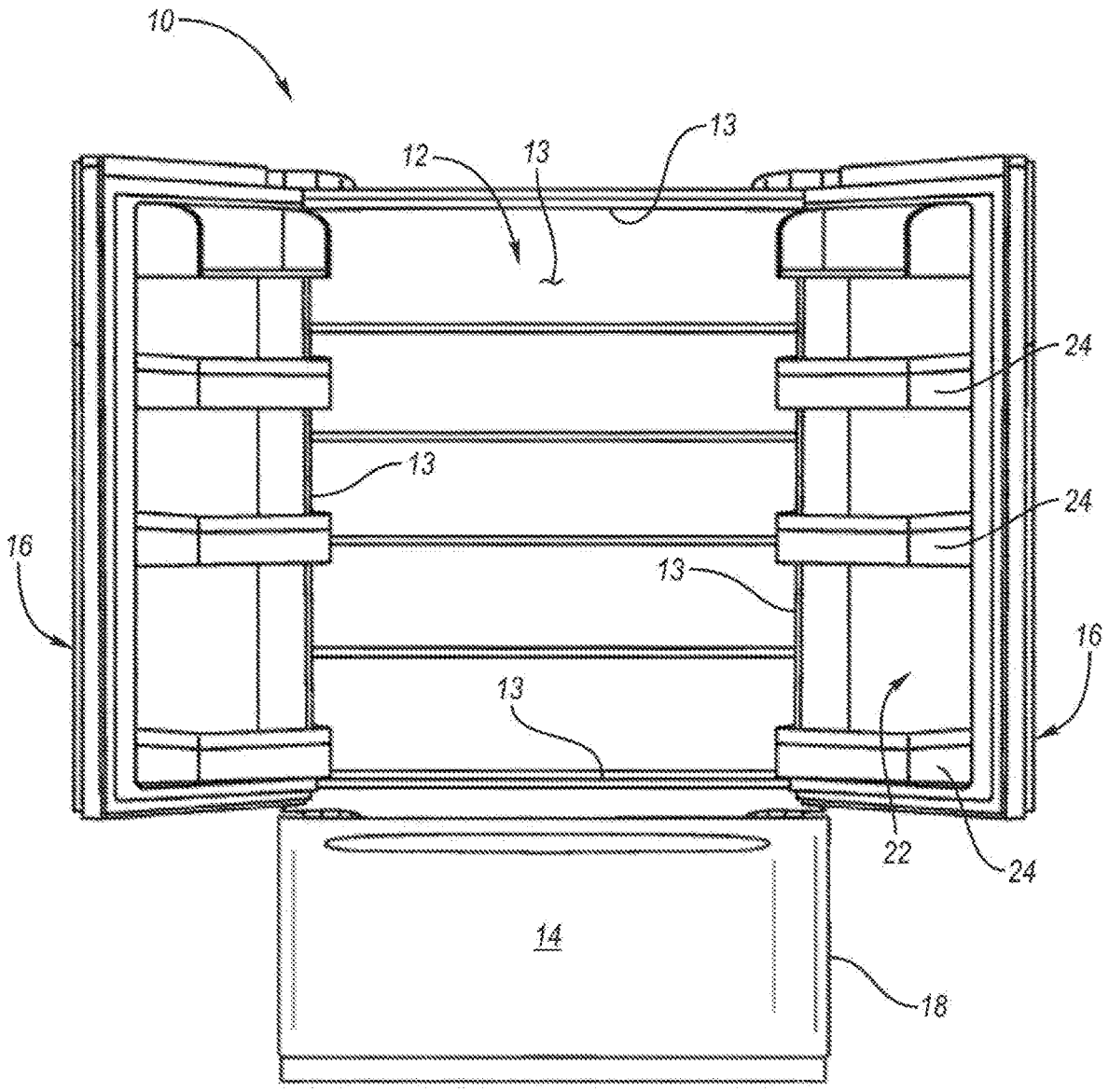
FIG. 2 is an elevated front view of a French-Door Bottom Mount type refrigerator with the refrigerator compartment doors open.

Referring to FIGS. 1 and 2, generally a refrigerator 10 of the French-Door Bottom Mount type is illustrated. However, it should be understood that this disclosure could apply to any type of refrigerator, such as a side-by-side, two-door bottom mount, or a top-mount type. As shown in FIGS. 1 and 2, the refrigerator 10 may have a first internal storage chamber or fresh food compartment 12 configured to refrigerate and not freeze consumables within the fresh food compartment 12, and a second internal storage chamber or a freezer compartment 14 configured to freeze consumables within the freezer compartment 14 during normal use. The refrigerator 10 includes panels or walls 13 that form a housing and define the fresh food compartment 12 and the freezer compartment 14. The walls 13 may more specifically form an internal liner of the refrigerator 10. The walls 13 may include a rear or back wall, a top wall, a bottom wall, and two side walls. One or more shelves may be secured to the walls 13 within the food compartment 12. The refrigerator 10 may have one or more doors 16, 18 that provide selective access to the interior volume of the refrigerator 10 where consumables may be stored. As shown, the fresh food compartment doors are designated 16, and the freezer door is designated 18. It may also be shown that the fresh food compartment 12 may only have one door 16. The doors 16 may be rotatably secured to the walls 13 by one or more hinges.

It is generally known that the freezer compartment 14 is typically kept at a temperature below the freezing point of water, and the fresh food compartment 12 is typically kept at a temperature above the freezing point of water and generally below a temperature of from about 35° F. to about 50° F., more typically below about 38° F.

The doors 16 may each include an exterior panel 20 and an interior panel 22 that is disposed on an internal side of the respective exterior panel 20 of each door 16. The interior panels 22 may be configured to face the fresh food 12 compartment when the doors 16 are in closed positions (See FIG. 1). The interior panel 22 may more specifically be a door liner. An insulating material, such as an insulating foam, may be disposed between the exterior panel 20 and interior panel 22 of each door 16 in order reduce the heat transfer from the ambient surroundings and increase the efficiency of the refrigerator.

The refrigerator 10 may also have a water inlet that is fastened to and in fluid communication with a household water supply of potable water. Typically, the household water supply connects to a municipal water source or a well. The water inlet may be fluidly engaged with one or more of a water filter, a water reservoir, and a refrigerator water supply line. The refrigerator water supply line may include one or more nozzles and one or more valves. The refrigerator water supply line may supply water to one or more water outlets; typically one outlet for water is in the dispensing area and another to an ice tray. The refrigerator 10 may also have a control board or controller that sends electrical signals to the one or more valves when prompted by a user that water is desired or if an ice making cycle is required.

Such a controller may be part of a larger control system and may be controlled by various other controllers throughout the refrigerator 10, and one or more other controllers can collectively be referred to as a "controller" that controls various functions of the refrigerator 10 in response to inputs or signals to control functions of the refrigerator 10. The controller may include a microprocessor or central processing unit (CPU) in communication with various types of computer readable storage devices or media. Computer readable storage devices or media may include volatile and nonvolatile storage in read-only memory (ROM), random-access memory (RAM), and keep-alive memory (KAM), for example. KAM is a persistent or non-volatile memory that may be used to store various operating variables while the CPU is powered down. Computer-readable storage devices or media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by the controller in controlling the refrigerator 10.

The doors 16 may also include storage bins 24 that are able to hold food items or containers. The storage bins 24 may be secured to the interior panels 22 of each door 16. Alternatively, the storage bins 24 may integrally formed within or defined by the interior panels 22 of each door 16. In yet another alternative, a portion of the storage bins 24 may be secured to the interior panels 22 of each door 16, while another portion of the storage bins 24 may be integrally formed within or defined by the interior panels 22 of each door 16. The storage bins 24 may include shelves (e.g., a lower surface upon, which a food item or container may rest upon) that extend from back and/or side surfaces of the interior panels 22 of each door 16.

Figure 3:
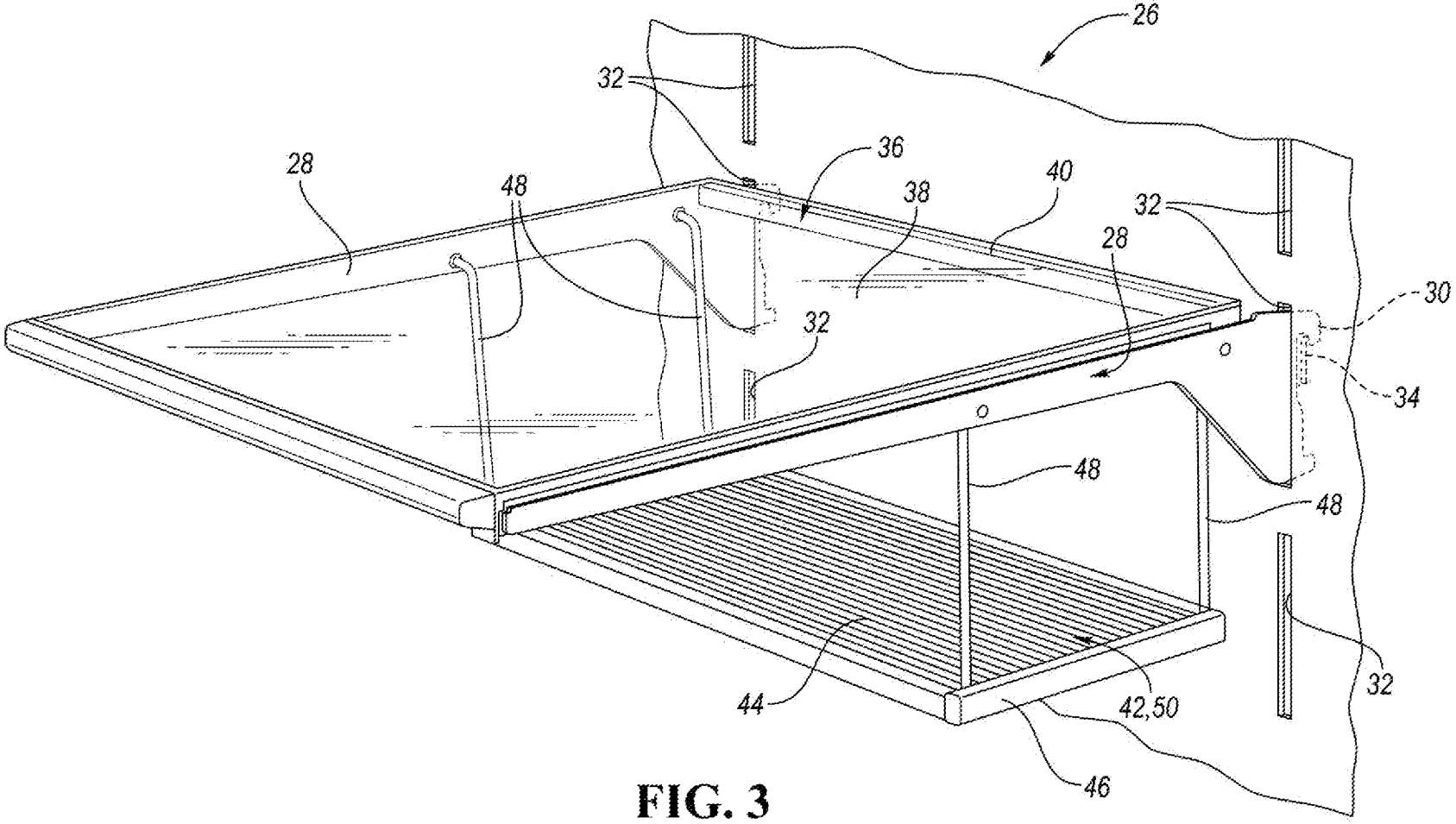
FIG. 3 is a top isometric view of a shelving system for the refrigerator that includes first and second shelves with the second shelf in a deployed position.
Figure 4:
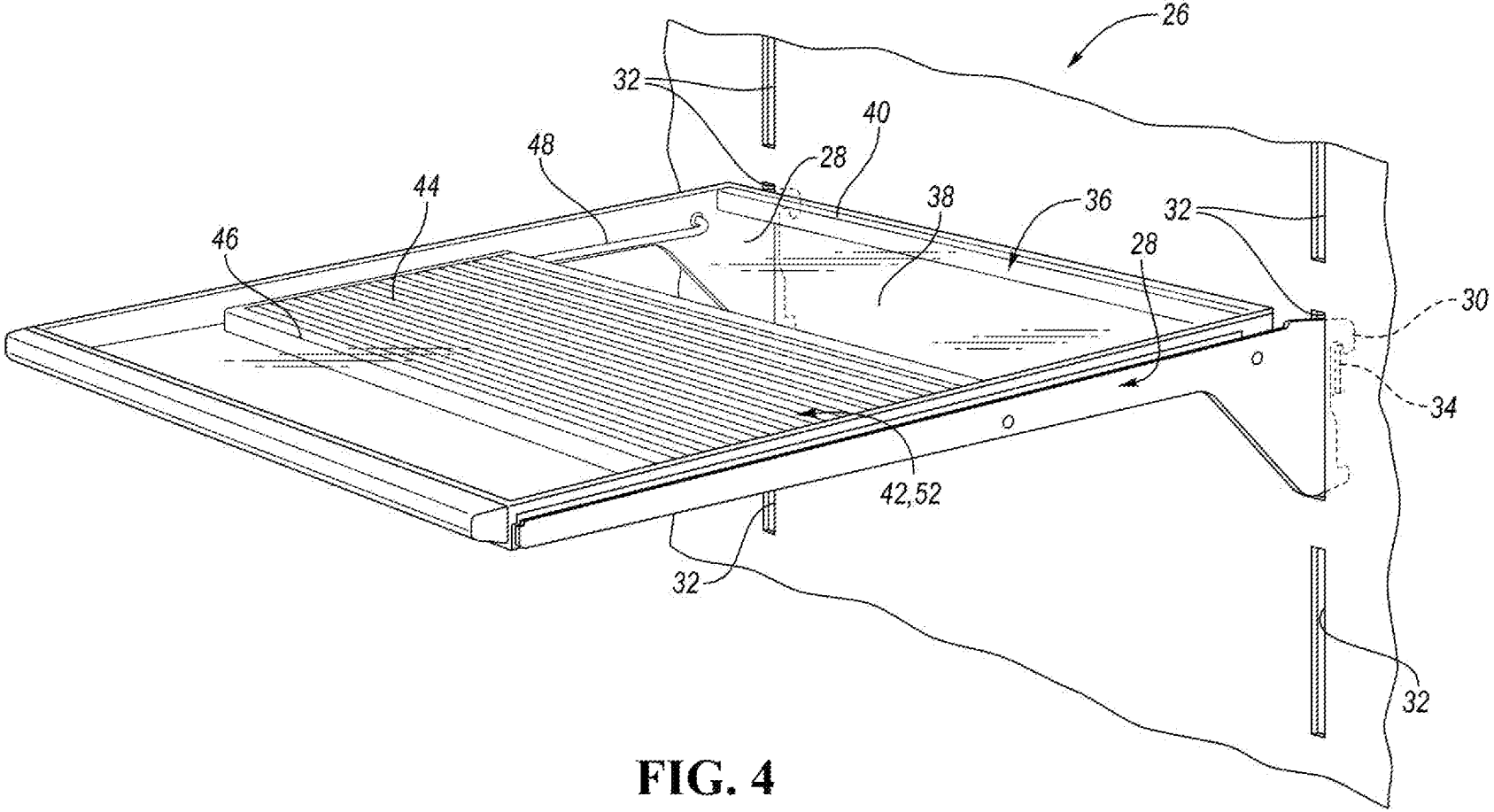
FIG. 4 is a top isometric view of a shelving system for the refrigerator that includes the first and second shelves with the second shelf in a stowed position.

Referring to FIGS. 2-4, a shelving system 26 for the refrigerator 10 is illustrated. The shelving system 26 may be disposed within the internal chamber (i.e., the fresh food compartment 12) of the refrigerator 10. A single shelving system 26 or multiple shelving systems that are identical to shelving system 26 may be disposed within the internal chamber of the refrigerator. It should be noted that any shelves illustrated in FIG. 2 may be removed or rearranged to create space for one or more of the shelving systems 26. The shelving system 26 may include support arms 28 that engage one of the walls 13 that define the internal chamber 12 in order to secure the position of the shelving system 26 within the internal chamber 12. More specifically, hooks 30 defined along the end of the support arms 28 may extend into notches 32 defined by the wall 13 and may engage upwardly extending protrusions 34, bumps, walls, etc. within the notches 32 to secure the position of the shelving system 26 within the internal chamber 12. The wall 13 may define a plurality of vertically aligned notches 32 having protrusions 34 disposed therein so that the shelving system 26 can be adjusted upward or downward between notches 32 in order to adjust a height of the shelving system 26 within the internal chamber 12.

Figure 5:
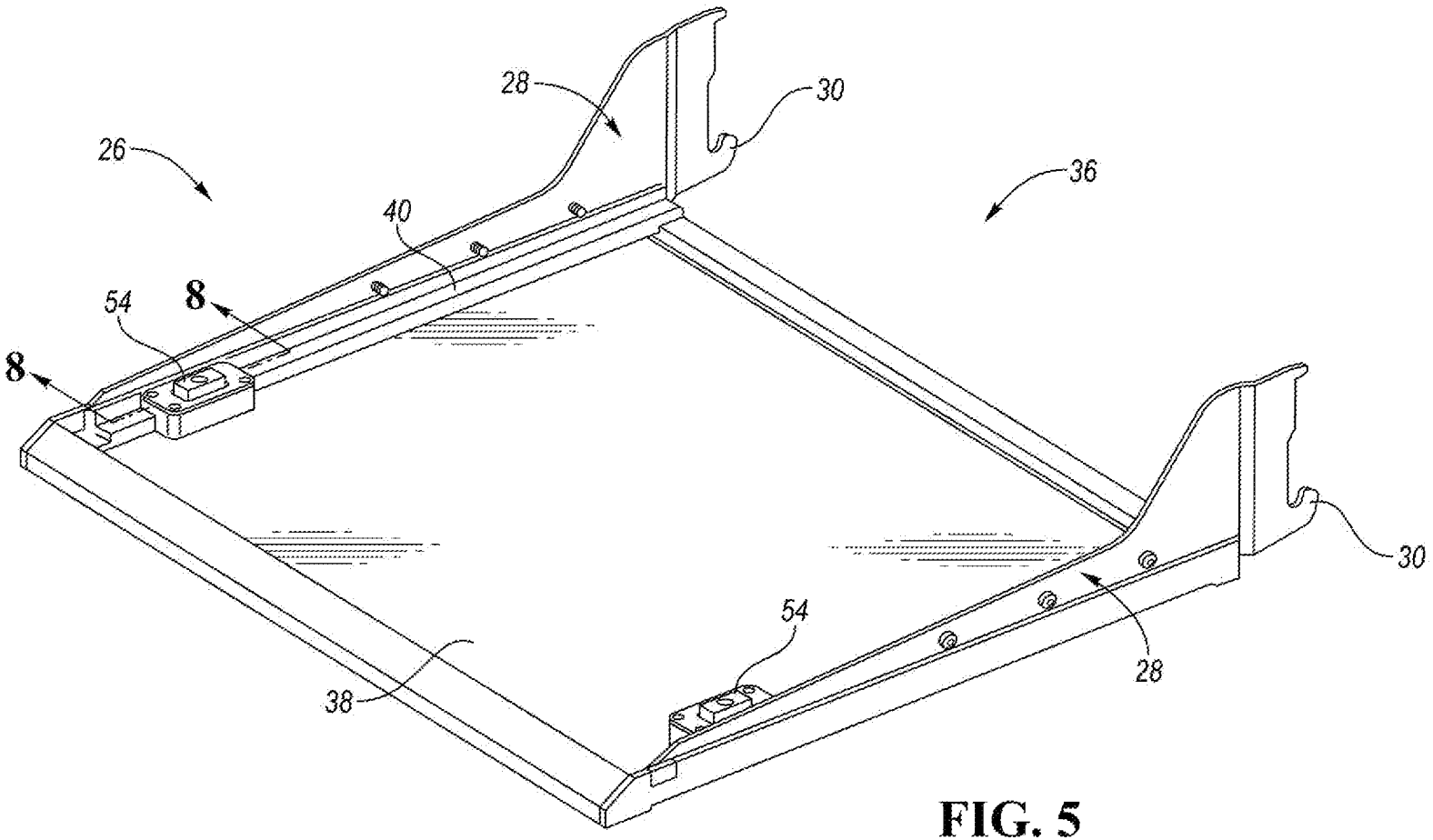
FIG. 5 is a partial bottom isometric view of the first shelf.
Figure 6:
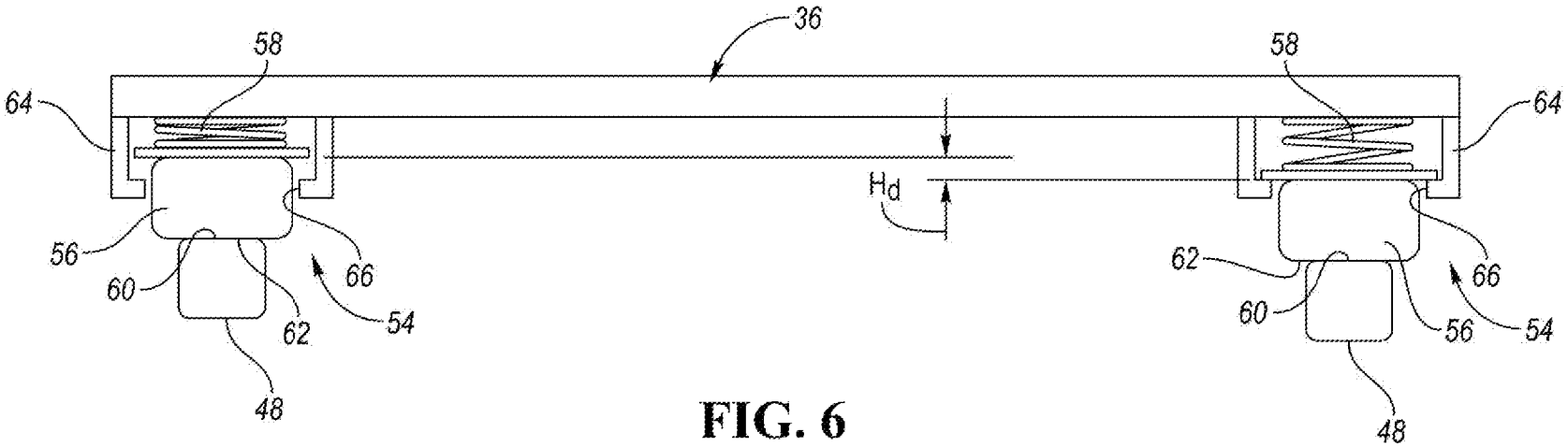
FIG. 6 is a diagrammatic side view of a nesting system for the second shelf.
Figure 7:
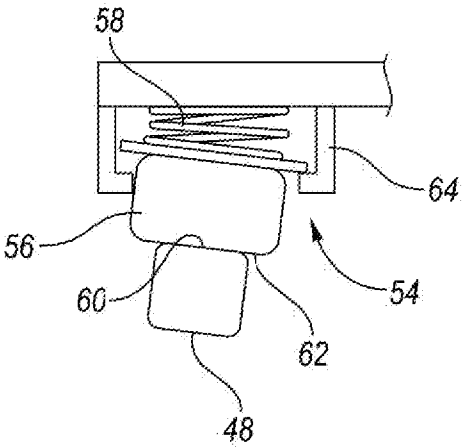
FIG. 7 is a diagrammatic side view of a nest for the second shelf.

The shelving system 26 includes an upper shelf 36 that is secured to or is integral to the support arms 28. The upper shelf 36 is secured to the wall 13 via the support arms 28. The upper shelf 36 has a support panel 38 upon which food or other items may be stored. Such items may be stored on top of the support panel 38. The support panel 38 may be leveled in order prevent items that are stored on top of the support panel 38 from rolling or falling off the support panel 38. The upper shelf 36 also includes a frame 40, which surrounds and provides structural support for the support panel 38. The support arms 28 may integrated into or secured to the frame 40. The support panel 38 is illustrated as being made from a transparent material, such as glass, in FIGS. 3-5 for illustrative purposes. It is noted that although the support panel 38 could be made from such a transparent material, this disclosure should not be construed as limited to such a configuration.

The shelving system 26 also includes a lower shelf 42 that is disposed below the upper shelf 36. The upper shelf 36 may be referred to as the first or primary shelf, while the lower shelf 42 may be referred to as the second or secondary shelf, or vice versa. The lower shelf 42 also has a support panel 44 upon which food or other items may be stored. Such items may be stored on top of the support panel 44. The lower shelf 42 also includes a frame 46, which surrounds and provides structural support for the support panel 44. The support panel 44 is illustrated as being made from a transparent material, such as glass, in FIGS. 3 and 4 for illustrative purposes. It is noted that although the support panel 44 could be made from such a transparent material, this disclosure should not be construed as limited to such a configuration.

One or more links, rods, suspenders, or hangers 48 are configured to secure the lower shelf 42 to the upper shelf 36. The hangers 48 are also configured to position and suspend the lower shelf 42 below the upper shelf 36. The hangers 48 are movably secured to both the upper shelf 36 and the lower shelf 42. The lower shelf 42 is movably secured to the upper shelf 36 via the hangers 48. More specifically, the hangers 48 may be rotatably secured to both the upper shelf 36 and the lower shelf 42. Even more specifically, the hangers 48 may be rotatably secured to the support arms 28 or lateral sides of the frame 40 of the upper shelf 36 along first ends and may be rotatably secured to lateral sides of the frame 46 of the lower shelf 42 along second ends. The lower shelf 42 is configured to transition via the hangers 48 between an (i) advanced, operational, or deployed position 50 where the lower shelf 42 is spaced-apart from and below the upper shelf 36 and (ii) a retracted, non-operational, or stowed position 52 where the lower shelf 42 is connected or nested to the upper shelf 36.

Referring now to FIGS. 5-11, a nesting system that is configured to secure the lower shelf 42 in the stowed position is illustrated. The nesting system includes one or more nests 54 that are secured to a bottom of the upper shelf 36. More specifically, the nests 54 may be secured to bottoms of the lateral sides of the frame 40. The nests 54 are configured to secure the lower shelf 42 to the upper shelf 36 in the stowed position 52. Each nest 54 includes a magnet 56. The magnets 56 are configured to engage one of the hangers 48 to secure the lower shelf 42 to the upper shelf 36 in the stowed position 52. Each nest 54 also includes a biasing element 58 (or multiple biasing elements). Each biasing element 58 is disposed between a corresponding magnet 56 and the upper shelf 36. Each biasing element 58 is configured to absorb energy in response to engagement between a corresponding hanger 48 and the corresponding magnet 56.

Each biasing element 58 is also configured to adjust an alignment of the corresponding magnet 56 in response to variations in a position of the corresponding hanger 48. More specifically, each biasing element 58 may facilitate a height adjustment of the corresponding magnet 56 (e.g., FIG. 6) or a rotational adjustment (e.g., FIG. 7) of the corresponding magnet 56 within a housing (e.g., housing 64 described below). Height adjustments to the magnets 56 may be desirable in the event there is a variation or height different, Ha, in the engagement between the hangers 48 and the magnets 56 on opposing lateral sides of the frame 40 of the upper shelf 36 when the lower shelf 42 is in the stowed position 52.

Rotational adjustments to the magnets 56 may be desirable in the event there is a variation between the surfaces 60 (e.g., upper surfaces) of the hangers 48 and the surfaces 62 (e.g., lower surfaces) of the magnets 56 that are in engagement when the lower shelf 42 is in the stowed position 52. Such variations between surfaces 60 and surfaces 62 may be due to surfaces 60 and/or surfaces 62 being non-uniform in shape; manufacturing tolerances of surfaces 60 and/or surfaces 62; manufacturing tolerances in assembly of the lower shelf 42 to the upper shelf 36; the surfaces 60 and surfaces 62 being non-planar prior to each other prior to engagement between the hangers 48 and the magnets 56; etc.

Each nest 54 may further include a housing 64 disposed along the bottom of the upper shelf 36. Each magnet 56 and corresponding biasing element 58 are disposed within a corresponding housing 64. Each housing 64 defines a downward facing opening 66. Each magnet 56 protrudes through the downward facing opening 66 of the corresponding housing 64. Each housing 64 is configured to limit upward and downward movement of a corresponding magnet 56.

Each nest 54 may further includes a mounting plate 68. Each biasing element 58 and corresponding magnet 56 of each nest 54 are each connected to a corresponding mounting plate 68. Each biasing element 58 protrudes upward from the corresponding mounting plate 68 and each magnet 56 protrudes downward from the corresponding mounting plate 68. Each mounting plate 68 is configured to engage a corresponding housing 64 proximate the corresponding downward facing opening 66 to limit downward movement of the corresponding magnet 56.

Each housing 64 may further include a cover plate 70 disposed along the bottom of the correspond housing 64. Each cover plate 70 may define the corresponding downward facing opening 66 and may engage the corresponding mounting plate 68 to limit downward movement of the corresponding magnet 56 (e.g., surfaces or ledges on the cover plate 70 may engage surfaces or ledges on the mounting plate 68 to limit downward movement of the corresponding magnet 56). Each cover plate 70 is removable from a remainder of the corresponding housing 64 to facilitate installation and removal of the corresponding magnet 56, corresponding biasing element 58, and corresponding mounting plate 68 into and from the corresponding housing 64.

Figure 9:
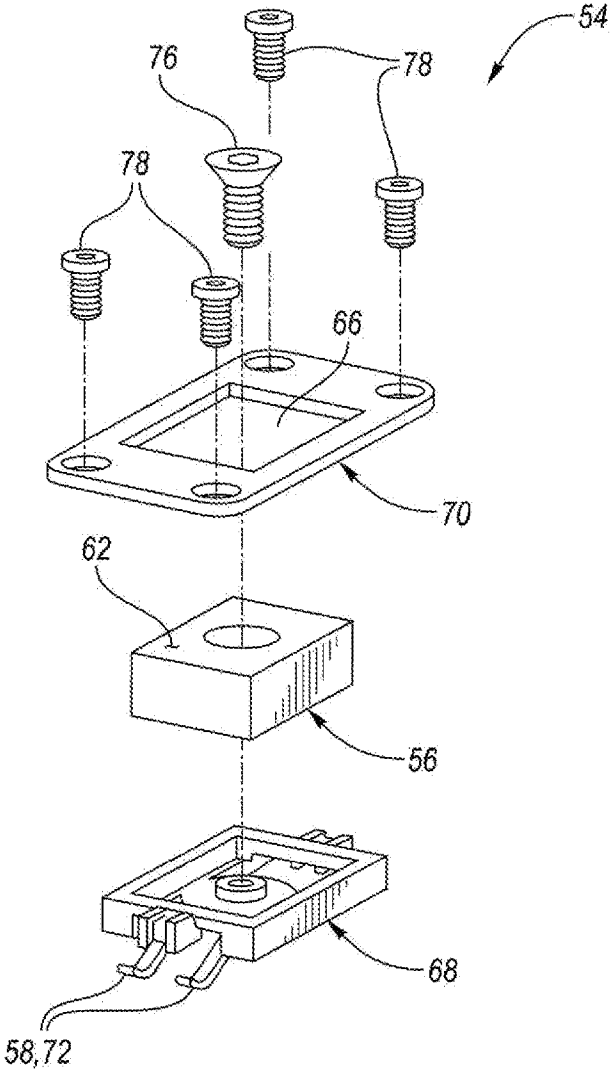
FIG. 9 is an exploded view of the internal components of the first embodiment of the nest.
Figure 8:
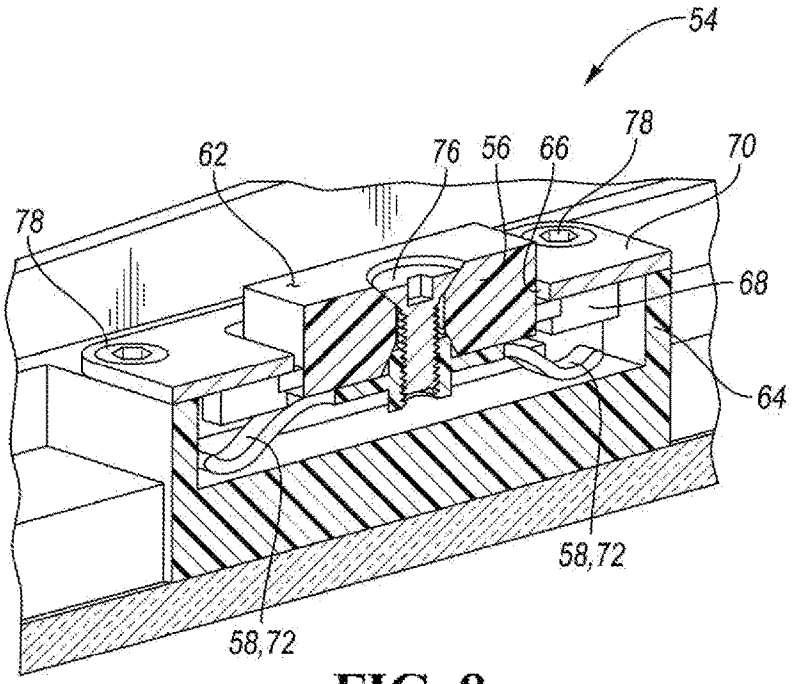
FIG. 8 is a cross-sectional view of a first embodiment of the nest for the second shelf taken along line 8-8 in FIG. 5.
Figure 11:
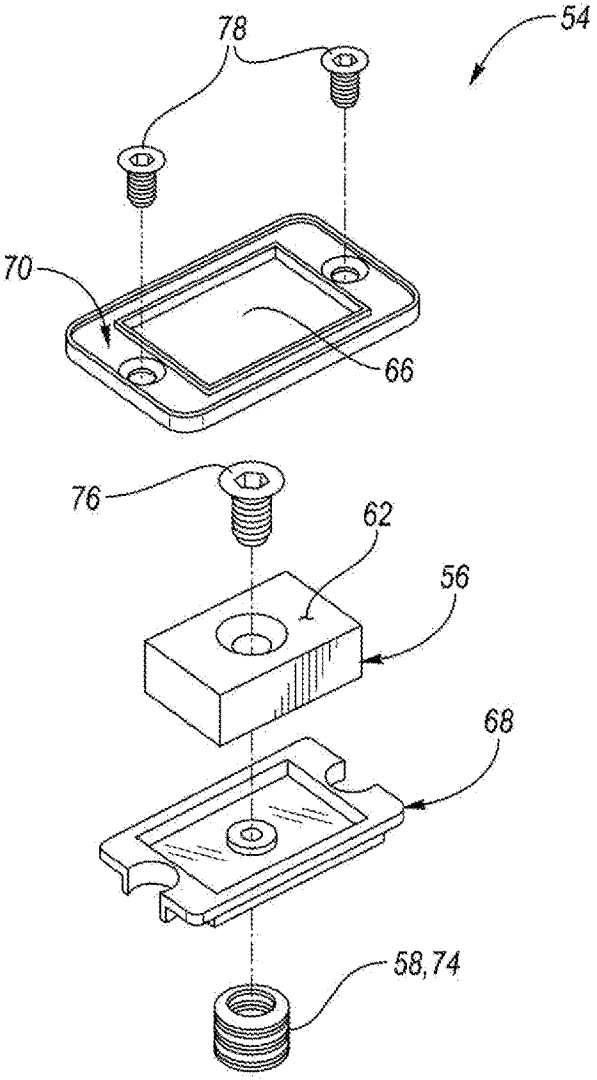
FIG. 11 is an exploded view of the internal components of the second embodiment of the nest.
Figure 10:
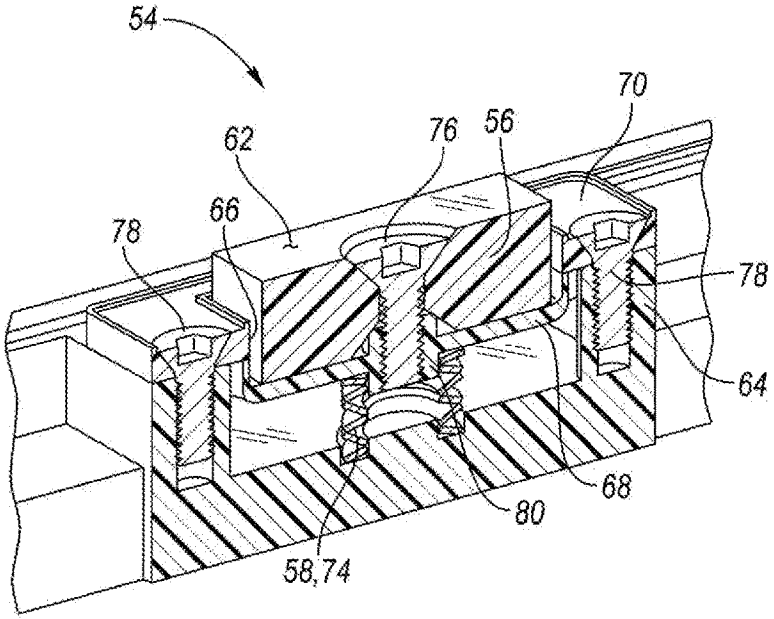
FIG. 10 is a cross-sectional view of a second embodiment of the nest for the second shelf taken along line 8-8 in FIG. 5.

The nests 54 as illustrated in FIGS. 8-9 slightly vary from the nests 54 as illustrated in FIGS. 10-11. For example, the biasing elements 58 are illustrated as resilient arms or leaf springs 72 in FIGS. 8-9, while the biasing elements 58 are illustrated as coil springs 74 or belleville springs in FIGS. 10-11. As another example, a fastener 76 extends through an orifice defined by the magnet 56, the fastener 76 engages a tapped hole defined by the biasing element 58, and the magnet 56 engages the mounting plate 68 in a keyed configuration to secure the magnet 56, biasing element 58, and mounting plate 68 to each other in FIGS. 8-9; while the fastener 76 extends through an orifice defined by the magnet 56, the fastener 76 engages a tapped hole defined by the mounting plate 68, the magnet 56 engages the mounting plate 68 in a keyed configuration, and the biasing element 58 is trapped in position by a protrusion 80 extending from the mounting plate 68 to secure the magnet 56, biasing element 58, and mounting plate 68 to each other in FIGS. 10-11. In yet another example, four fasteners 78 are utilized to secure the cover plate 70 in position in FIGS. 8-9 while two fasteners 78 are utilized to secure the cover plate 70 in position in FIGS. 10-11. It is further noted that the biasing elements 58 may or may not be integrally formed with the mounting plate 68 in FIGS. 8-9.

Figure 12:
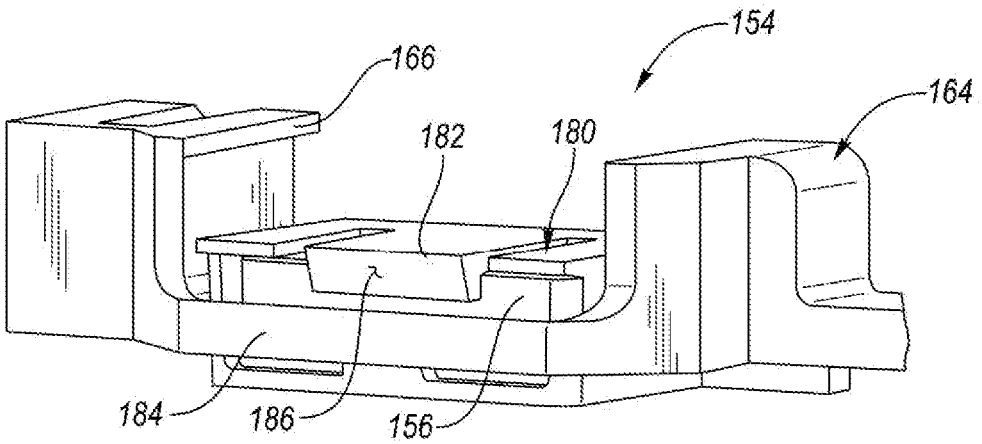
FIG. 12 is an isometric front view of a third embodiment of the nest for the second shelf.
Figure 13:
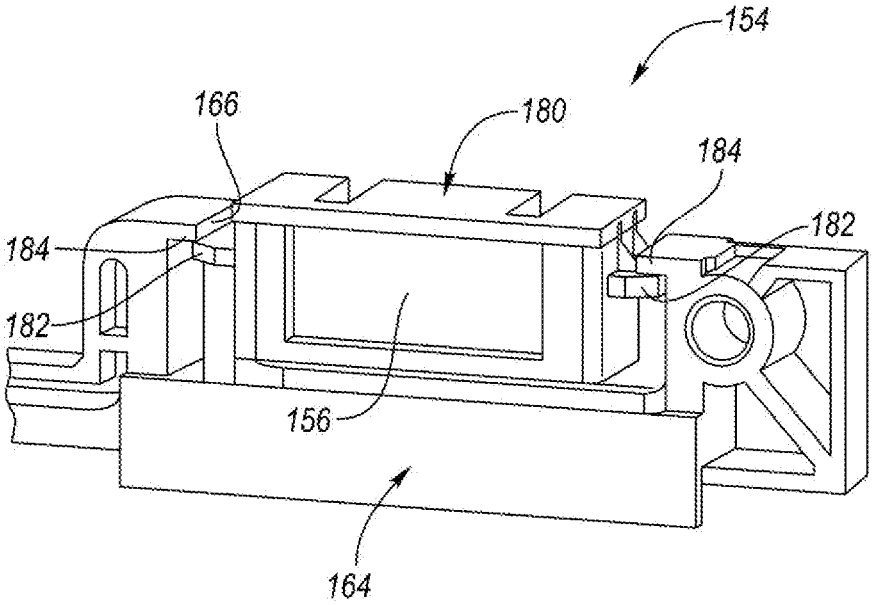
FIG. 13 is an isometric front rear of the third embodiment of the nest for the second shelf.

Referring to a FIGS. 12-13, an alternative embodiment of a nest 154 is illustrated. The nest 154 may have the same structure and functionally as nest 54 unless otherwise stated or described herein. The elements of the nest 154 that are common to elements of nest 54 will have the same structure and functionally unless otherwise stated or described herein. Multiple nests 154 may be utilized in the same manner as described herein with respect to nest 54 (e.g., See FIGS. 5 and 6). Nests 154 are configured to secure the lower shelf 42 to the upper shelf 36 in the stowed position 52. Each nest 154 includes a housing 164 and magnets 156 vertically slidable within a corresponding housing 164. The magnets 156 are configured to engage the hangers 48 to maintain the lower shelf 42 in the stowed position 52.

Vertical positions or heights and of the magnets 156 are variable within the housing to compensate for variations in positions of the hangers 48. Height adjustments to the magnets 156 may be desirable in the event there is a variation or height different, Ha, in the engagement between the hangers 48 and the magnets 156 on opposing lateral sides of the frame 40 of the upper shelf 36 when the lower shelf 42 is in the stowed position 52. Rotational positions of the magnets 156 are variable within the housings 164 to compensate for variations in external surfaces of the hangers 48.

Rotational adjustments to the magnets 156 may be desirable in the event there is a variation between the surfaces (e.g., upper surfaces) of the hangers 48 and the surfaces (e.g., lower surfaces) of the magnets 156 that are in engagement when the lower shelf 42 is in the stowed position 52. Such variations between surfaces may be due to the surfaces being non-uniform in shape; manufacturing tolerances of surfaces; manufacturing tolerances in assembly of the lower shelf 42 to the upper shelf 36; the engaging surfaces of the hangers 48 and magnets 156 being non-planar prior to each other prior to engagement between the hangers 48 and the magnets 156; etc.

The housings 164 define downward facing openings 166. The magnets 156 protrude through the downward facing openings 166. The housings 164 are configured to limit upward and downward movement of the magnets 156. Flexible or resilient sleeves 180 may be disposed about the magnets 156. The resilient sleeves 180 are configured to absorb energy in response to engagement between the hangers 48 and the magnets 156 (e.g., the impact energy between the hangers 48 and the magnets 156 during transition of the lower shelf 42 to the stowed position 52). The resilient sleeves 180 may include protrusions 182. The housings 164 may include ledges 184. The protrusions 182 may be configured to engage the ledges 184 to limit upward and downward movement of the magnets 156 within the housings 164. At least a portion of the protrusions 182 may include one or more ramped surfaces 186 to guide the magnets 156 toward desired positions.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The words used in the specification are words of description rather than limitation, and it is understood that various changes may be made without departing from the spirit and scope of the disclosure. As previously described, the features of various embodiments may be combined to form further embodiments that may not be explicitly described or illustrated. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A refrigerator shelving system comprising:

an upper shelf;

a hanger secured to the upper shelf;

a lower shelf (i) suspended below the upper shelf via the hanger and (ii) configured to transition via the hanger between (a) a deployed position where the lower shelf is spaced-apart from the upper shelf and (b) a stowed position where the lower shelf is nested to the upper shelf;

a nest (i) secured to a bottom of the upper shelf and (ii) configured to secure the lower shelf in the stowed position, wherein the nest includes (a) a magnet configured to engage the hanger to secure the lower shelf in the stowed position and (b) a biasing element disposed between the magnet and the upper shelf, wherein the biasing element is (I) configured to absorb energy in response to engagement between the hanger and the magnet and (II) adjust an alignment of the magnet in response to variations in a position of the hanger;

a housing disposed along the bottom of the upper shelf, wherein (i) the magnet and the biasing element are disposed within the housing, (ii) the housing defines a downward facing opening, (iii) the magnet protrudes through the downward facing opening, and (iv) the housing is configured to limit upward an ward movement of the magnet; and a mounting plate, wherein (i) the biasing element and the magnet are each connected to the mounting plate, (ii) the biasing element protrudes upward from the mounting plate, (iii) the magnet protrudes downward from the mounting plate, and (iv) the mounting plate is configured to engage the housing proximate the downward facing opening to limit downward movement of the magnet.

2. The shelving system of claim 1, wherein the housing further comprises a cover plate disposed along the bottom of the housing, wherein the cover plate (i) defines the downward facing opening and (ii) engages the mounting plate to limit downward movement of the magnet.

3. The shelving system of claim 2, wherein the cover plate is removable from a remainder of the housing to facilitate installation and removal of the magnet, biasing element, and mounting plate into and from the housing.

4. The shelving system of claim 1, wherein the biasing element facilitates a height adjustment of the magnet within the housing.

5. The shelving system of claim 1, wherein the biasing element facilitates a rotational adjustment of the magnet within the housing.

6. The shelving system of claim 1, wherein the biasing element is a leaf spring.

7. The shelving system of claim 1, wherein the biasing element is a coil spring.

8. The shelving system of claim 1, wherein the biasing element is a Belleville spring.

9. A refrigerator shelving system comprising:

a first shelf;

a second shelf;

first and second hangers rotatably secured to the first and second shelves such that the second shelf is configured rotate via the first and second hangers between (i) an operational position where the second shelf is spaced-apart from the first shelf and (ii) a stowed position where the second shelf is nested to the first shelf;

first and second magnets (i) secured to the first shelf and (ii) configured to engage the first and second hangers, respectively, to secure the second shelf in the stowed position;

first and second biasing elements disposed between the first shelf and the first and second magnets, respectively, wherein the first and second biasing elements are (i) configured to absorb energy in response to engagement between the first and second hangers and the first and second magnets and (ii) adjust an alignment of the first and second magnets in response to variations in positions of the first and second hangers;

first and housings disposed along a bottom of the first shelf, wherein (i) the first magnet and the first biasing element are disposed within the first housing, (ii) the second magnet and the second biasing element are disposed within the second housing, (iii) the first and second housings define first and second downward facing openings, respectively, (iv) the first and second magnets protrude through the first and second downward facing openings, and (v) the first and second housings are configured to limit upward and downward movement of the first and second magnets; and first and second mounting plates, wherein (i) the first biasing element and the first magnet are each secured to the first mounting plate, (ii) the second biasing element and the second magnet are each connected to the second mounting plate, (iii) the first and second biasing elements protrude upward from the first and second mounting plates, respectively, (iv) the first and second magnets protrude downward from the first and second mounting plates, respectively, and (v) the first and second mounting plates are configured to engage the first and second housings proximate the first and second downward facing openings, respectively, to limit downward movement of the first and second magnets, respectively.

10. The shelving system of claim 9, wherein the first and second biasing elements facilitate height adjustments for the first and second magnets, respectively, to accommodate varying heights of the first and second hangers.

11. The shelving system of claim 9, wherein the first and second biasing elements facilitate rotational adjustments for the first and second magnets, respectively, to accommodate varying external surfaces of the first and second hangers.

12. The shelving system of claim 9, wherein the first and second housings further comprise first and second cover plates disposed along bottom of the first and second housings, respectively, wherein the first and second cover plates (i) define the first and second downward facing openings and (ii) engage the first and second mounting plates to limit downward movement of the first and second magnets, respectively.

13. The shelving system of claim 12, wherein the first and second cover plates are removable from remainders of the first and second housings, respectively, to facilitate installation and removal of the first and second magnets, the first and second biasing elements, and the first and second mounting plates into and from the first and second housings, respectively.

14. The shelving system of claim 9, wherein the first and second biasing elements are leaf springs.

15. The shelving system of claim 9, wherein the first and second biasing elements are coil springs.

16. The shelving system of claim 9, wherein the first and second biasing elements are Belleville springs.

17. A refrigerator shelving system comprising:

a primary shelf;

a secondary shelf;

hangers (1) movably securing the secondary shelf to the primary shelf and (ii) positioning the secondary shelf below the primary shelf;

nests configured to secure the secondary shelf to the primary shelf in a stowed position, wherein the nests include (i) housings and (ii) magnets vertically slidable within the housings, wherein (a) the magnets are configured to engage the hangers to maintain the secondary shelf in the stowed position and (b) vertical positions of the magnets are variable within the housings to compensate for variations in positions of the hangers; and resilient sleeves disposed about the magnets, wherein the resilient sleeves are configured to absorb energy in response to engagement between the hangers and the magnets, and wherein (i) the resilient sleeves include protrusions, (ii) the housings include ledges, and (iii) the protrusions are configured to engage the ledges to limit upward and downward movement of the magnets within the housings.

18. The shelving system of claim 17, wherein (i) the housings define downward facing openings, (ii) the magnets protrude through the downward facing openings, and (iii) the housings are configured to limit upward and downward movement of the magnets.

19. The shelving system of claim 17, wherein a least a portion of the protrusions include a ramped surfaces to guide the magnets toward desired positions.

20. The shelving system of claim 17, wherein rotational positions of the magnets are variable within the housing to compensate for variations in external surfaces of the hangers.

* * * * *